US010558134B2

(12) United States Patent
Koike et al.

(10) Patent No.: US 10,558,134 B2
(45) Date of Patent: Feb. 11, 2020

(54) IMAGE FORMING APPARATUS

(71) Applicant: Ricoh Company, Ltd., Tokyo (JP)

(72) Inventors: Toshio Koike, Tokyo (JP); Teppei Kikuchi, Kanagawa (JP); Michiharu Suzuki, Kanagawa (JP); Keinosuke Kondoh, Kanagawa (JP); Jun Shiori, Kanagawa (JP); Kazuhiro Aso, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/198,947

(22) Filed: Nov. 23, 2018

(65) Prior Publication Data

US 2019/0212668 A1 Jul. 11, 2019

(30) Foreign Application Priority Data

Jan. 10, 2018 (JP) ..... 2018-001695

(51) Int. Cl.
*G03G 15/01* (2006.01)
*G03G 15/00* (2006.01)
*G03G 15/08* (2006.01)

(52) U.S. Cl.
CPC ..... *G03G 15/0121* (2013.01); *G03G 15/0879* (2013.01); *G03G 15/5087* (2013.01)

(58) Field of Classification Search
CPC ..... G03G 15/0121; G03G 15/0863; G03G 15/0877; G03G 15/0879; G03G 15/553; G03G 15/6585; G03G 2215/119
USPC ..... 399/9, 12, 13, 27, 222, 224
See application file for complete search history.

(56) References Cited

U.S. PATENT DOCUMENTS 8,676,073 B2 * 3/2014 Murata ..... G03G 15/0875 399/254
9,031,435 B2 * 5/2015 Sato ..... G03G 15/0121 399/54
2015/0055966 A1 2/2015 Matsumoto et al.
2015/0078788 A1 3/2015 Koike et al.
(Continued)

FOREIGN PATENT DOCUMENTS

JP 9-134075 5/1997
JP 10-239969 9/1998
(Continued)

*Primary Examiner* — Hoan H Tran
(74) *Attorney, Agent, or Firm* — Xsensus LLP

(57) ABSTRACT

An image forming apparatus includes image bearers, developing devices, developer containers, and developer supply devices. The image bearers are arranged side by side along a movement direction of an intermediate transferor or a sheet. The developing devices, the developer containers, and the developer supply devices are configured to be rearrangeable for each color in the movement direction in a manner that one or each of a developing device, a developer container, and a developer supply device corresponding to each color of the different colors is detached from and attached to the image forming apparatus, separately from a rest of the developing device, the developer container, and the developer supply device. The image forming apparatus is configured to be available for use when colors of the developing device, the developer container, and the developer supply device correspond to each other after rearrangement.

12 Claims, 7 Drawing Sheets

(56) References Cited

U.S. PATENT DOCUMENTS

| | | | |
|---|---|---|---|
| 2015/0139671 | A1 | 5/2015 | Matsumoto et al. |
| 2015/0227086 | A1 | 8/2015 | Kondoh et al. |
| 2016/0026113 | A1 | 1/2016 | Takahashi et al. |
| 2016/0223946 | A1 | 8/2016 | Kikuchi et al. |

FOREIGN PATENT DOCUMENTS

| | | |
|---|---|---|
| JP | 2010-204353 | 9/2010 |
| JP | 2014-026201 | 2/2014 |
| JP | 2016-031469 | 3/2016 |
| JP | 2017-021264 | 1/2017 |

* cited by examiner

IMAGE FORMING APPARATUS

CROSS-REFERENCE TO RELATED APPLICATION

This patent application is based on and claims priority pursuant to 35 U.S.C. § 119(a) to Japanese Patent Application No. 2018-001695, filed on Jan. 10, 2018, in the Japan Patent Office, the entire disclosure of which is hereby incorporated by reference herein.

BACKGROUND

Technical Field

This disclosure generally relates to an image forming apparatus such as a copier, a printer, a facsimile machine, or a multifunction peripheral (MFP) having at least two of copying, printing, facsimile transmission, plotting, and scanning capabilities.

Description of the Related Art

Among image forming apparatuses, such as copiers, printers, facsimile machines, or MFPs, there are image forming apparatuses including image forming devices, which form different color images, arranged side by side for forming multicolor images.

SUMMARY

According to embodiments of the present disclosure, an improved image forming apparatus includes a plurality of image bearers, a plurality of developing devices, a plurality of developer containers, and a plurality of developer supply devices. The plurality of image bearers is arranged side by side along a movement direction of an intermediate transferor or a sheet. The plurality of developing devices, the plurality of developer containers, and the plurality of developer supply devices are configured to be rearrangeable for each color in the movement direction in a manner that one or each of a developing device, a developer container, and a developer supply device corresponding to each color of the different colors is detached from and attached to the image forming apparatus, separately from a rest of the developing device, the developer container, and the developer supply device. The image forming apparatus is configured to be available for use when colors of the developing device, the developer container, and the developer supply device correspond to each other after rearrangement of the plurality of developing devices, plurality of developer containers, and the plurality of developer supply devices.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
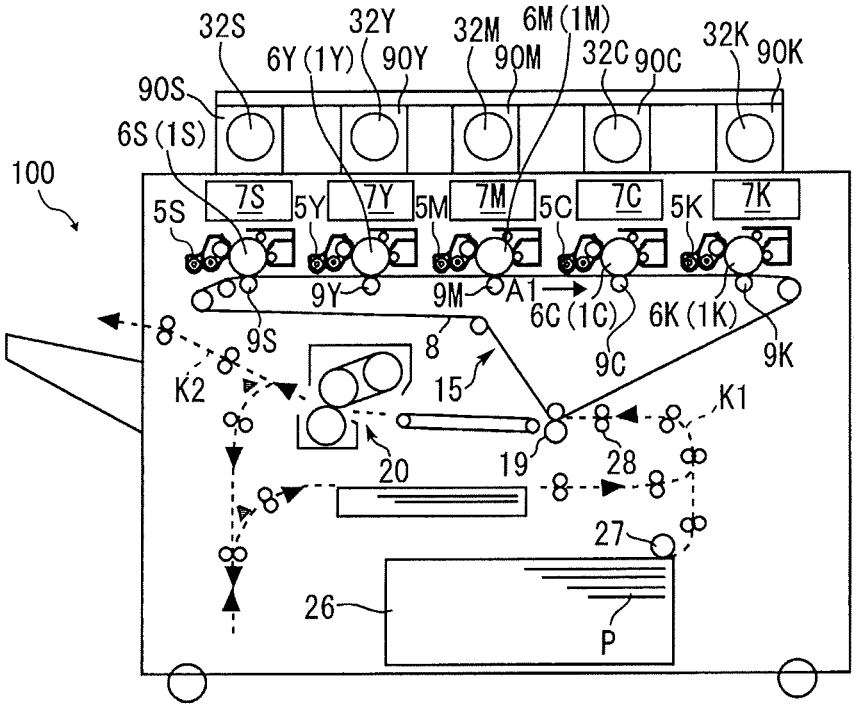
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, K, and S attached to each reference numeral indicate only that components indicated thereby are used for forming yellow, magenta, cyan, black, and special color images, respectively, and hereinafter may be omitted when color discrimination is not necessary.

Embodiments of the present disclosure are described in detail with reference to drawings. Identical reference numerals are assigned to identical components or equivalents and a description of the components is simplified or omitted.

First Embodiment

A detailed description is provided below of an embodiment of the present disclosure referring to FIGS. 1 through 6.

Figure 2:
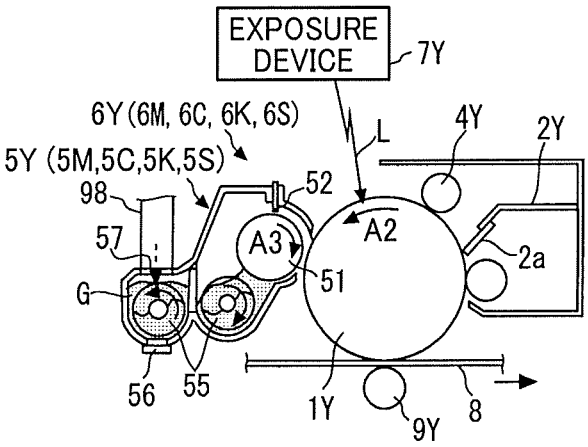
FIG. 2 is a cross-sectional view of a process cartridge and vicinity thereof in the image forming apparatus illustrated in FIG. 1.

Referring to FIGS. 1 and 2, a configuration and operation of an image forming apparatus 100 according to the present embodiment are described below.

FIG. 1 is a schematic view illustrating a configuration of the image forming apparatus 100, which in the present embodiment is a printer, for example. FIG. 2 is an enlarged view of a process cartridge 6Y and vicinity thereof in the image forming apparatus 100 illustrated in FIG. 1.

As illustrated in FIG. 1, the image forming apparatus 100 includes an intermediate transfer belt 8 as an intermediate transferor that moves in a predetermined direction of movement of the intermediate transfer belt 8 indicated by arrow A1 in FIG. 1, in a center of the image forming apparatus 100. A plurality of photoconductor drums 1Y, 1M, 1C, 1K, and 1S as a plurality of image bearers is disposed facing an intermediate transfer belt 8 and arranged side by side along the direction of movement of the intermediate transfer belt 8.

A plurality of developing devices 5Y, 5M, 5C, 5K, and 5S is removably installed in the image forming apparatus 100. The plurality of developing devices 5Y, 5M, 5C, 5K, and 5S develops latent images formed on the plurality of photoconductor drums 1Y, 1M, 1C, 1K, and 1S (the plurality of image bearers) with different colors.

As illustrated in FIG. 1, a plurality of toner containers 32Y, 32M, 32C, 32K, and 32S as a plurality of developer containers contains toners of different colors as developer therein and is removably installed in an upper portion of the image forming apparatus 100.

Figure 3:
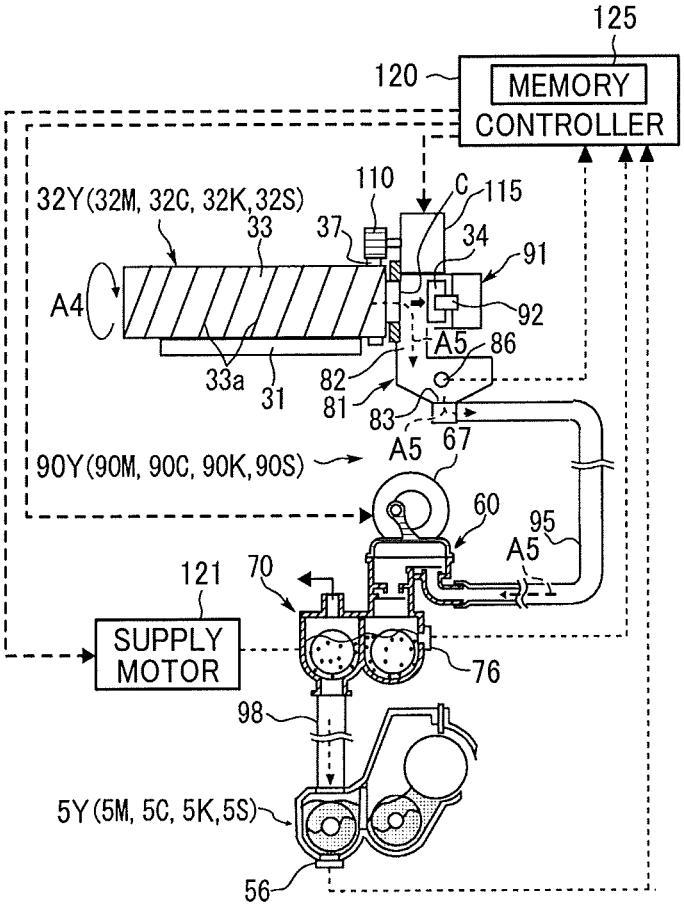
FIG. 3 is a schematic view illustrating a configuration of a developer supply device in the image forming apparatus illustrated in FIG. 1.

A plurality of developer supply devices 90Y, 90M, 90C, 90K, and 90S is removably installed in the image forming apparatus 100 to supply the toners contained in the plurality of toner containers 32Y, 32M, 32C, 32K, and 32S to the plurality of developing devices 5Y, 5M, 5C, 5K, and 5S, respectively. Referring to FIG. 3, the plurality of developer supply devices 90Y, 90M, 90C, 90K, and 90S includes a cap holder 91, a reservoir 81, a conveyance pump 60, a sub-hopper 70, a tube 95, and a conveyance pipe 98.

More specifically, the five toner containers 32Y, 32M, 32C, 32K, and 32S (the developer containers), which are substantially cylindrical in the present embodiment, are removably installed in the developer supply devices 90Y, 90M, 90C, 90K, and 90S (the toner supply device), respectively.

As illustrated in FIG. 1, the toner container 32K (and the developer supply device 90K) for black is disposed on the rightmost side of the toner containers 32Y, 32M, 32C, 32K, and 32S (collectively referred to as the toner containers 32). On the left side of the toner container 32K, the toner containers 32Y, 32M, and 32C (and the developer supply devices 90Y, 90M, and 90C) corresponding to three colors (yellow, magenta, and cyan) are disposed in order of cyan, magenta, and yellow from the right. A toner container 32S (and the developer supply device 90S) for special color is disposed on the leftmost side of the toner containers 32.

In particular, the toner container 32S for special color is often replaced with a toner container 32S for another type of special color depending on usage before all of the toner contained therein is consumed. Accordingly, the toner container 32S is replaced more frequently than the other toner containers 32Y, 32M, 32C, and 32K are.

Figure 5A:
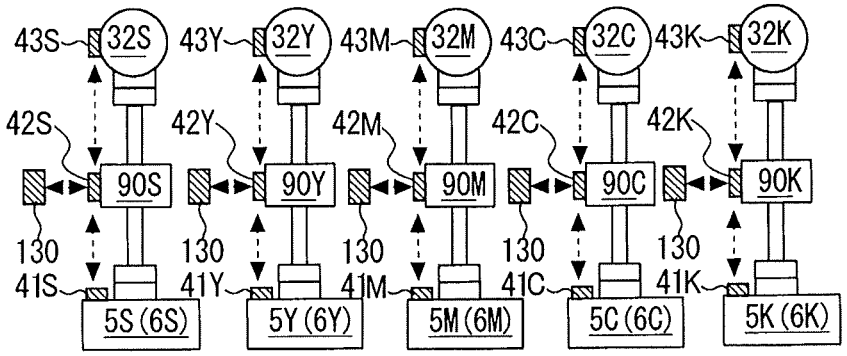
FIG. 5A is a block diagram illustrating an arrangement of components of the image forming apparatus according to a first embodiment when toner images are primarily transferred in the order of special color, colors, and black from an upstream side in a direction of movement of an intermediate transfer belt in the image forming apparatus.
Figure 5B:
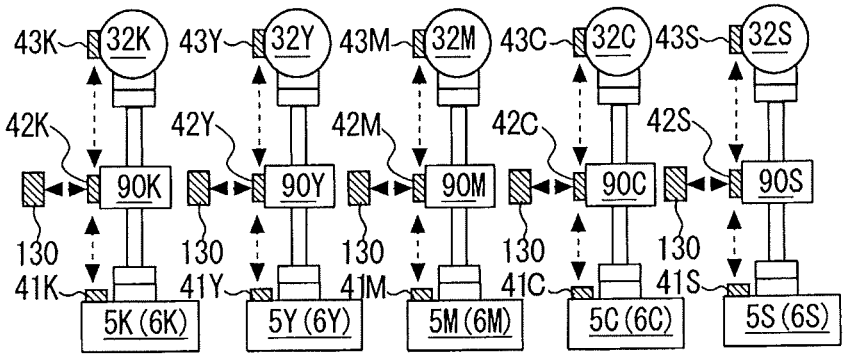
FIG. 5B is a block diagram illustrating the arrangement of components of the image forming apparatus according to the first embodiment when toner images are primarily transferred in the order of black, colors, and special color from the upstream side in the direction of movement of the intermediate transfer belt in the image forming apparatus.

Referring to FIGS. 1, 5A, and 5B, the developer supply device 90K for black supplies black toner (developer) contained in the toner container 32K (the developer container) for black to the developing device 5K for black.

The three developer supply devices 90Y, 90M, and 90C for colors of yellow, magenta, and cyan supply color toners of yellow, magenta, and cyan (developers) contained in the toner containers 32Y, 32M, and 32C (the developer containers) for colors to the developing devices 5Y, 5M, and 5C for colors, respectively.

The developer supply device 90S for special color supplies special color toner (developer) contained in the toner container 32S (the developer container) for special color to the developing device 5S for special color.

Any known toner can be used as the black toner; the color toner of each of yellow, magenta, and cyan; or the special color toner.

In particular, the special color toner is different from the black toner and the color toner, and known clear toner (transparent toner, colorless toner, achromatic toner, no-pigment toner, or the like), white toner, or the like can be used depending on usage.

Referring to FIG. 1, five exposure devices 7Y, 7M, 7C, 7K, and 7S are disposed in an upper section of the image forming apparatus 100, and process cartridges 6Y, 6M, 6C, 6K, and 6S, including the developing devices 5Y, 5M, 5C, 5K, and 5S as illustrated in FIG. 2, corresponding to yellow, magenta, cyan, black, and special color are disposed side by side under the exposure devices 7Y, 7M, 7C, 7K, and 7S, facing an intermediate transfer device 15 including an intermediate transfer belt 8.

As illustrated in FIGS. 1 and 5A, in a basic arrangement order (an arrangement), the five process cartridges 6Y, 6M, 6C, 6K, and 6S, including the developing devices 5Y, 5M, 5C, 5K, and 5S, are disposed in the order of the process cartridge 6S (the developing device 5S) for special color, the process cartridge 6Y (the developing device 5Y) for yellow, the process cartridge 6M (the developing device 5M) for magenta, the process cartridge 6C (the developing device 5C) for cyan, and the process cartridge 6K (the developing device 5K) for black from an upstream side in the direction of movement of the intermediate transfer belt 8 (hereinafter, referred to as a movement direction).

The five toner containers 32Y, 32M, 32C, 32K and 32S and the five developer supply devices 90Y, 90M, 90C, 90K, and 90S are arranged in the same order of the process cartridges 6Y, 6M, 6C, 6K, and 6S (the developing devices 5Y, 5M, 5C, 5K, and 5S).

However, the arrangement order (the arrangement) is appropriately variable depending on usage.

Referring to FIGS. 5A and 5B, it can be seen that, in the first embodiment, the process cartridge 6K (the developing device 5K), the toner container 32K, and the developer supply device 90K for black and the process cartridge 6S (the developing device 5S), the toner container 32S, and the developer supply device 90S for special color can be swapped.

The special color toner is not limited to one type, and in many cases, different types of toner containers 32S for special colors are installed as appropriate depending on usage. For example, the toner container 32S for clear toner may be replaced with the toner container 32S for white toner.

In such a case, depending on the type of special color toner, the process cartridge 6S (the developing device 5S) for special color is preferably moved from an extreme upstream installation position to an extreme downstream installation position in the movement direction of the intermediate transfer belt 8. For example, the clear toner as the special color toner is often used for improving the glossiness of an image, and it is desirable that the clear toner be primarily transferred onto the intermediate transfer belt 8 first. Accordingly, as illustrated in FIGS. 1 and 5A, the process cartridge 6S (the developing device 5S) for special color is disposed at the extreme upstream installation position in the movement direction of the intermediate transfer belt 8. On the other hand, the white toner as the special color toner is often used for forming an image on a colored sheet P that is not white, and it is desirable that the white toner be secondarily transferred in the lowermost layer on the sheet P. Accordingly, the process cartridge 6S (the developing device 5S) for special color is disposed at the extreme downstream installation position in the movement direction of the intermediate transfer belt 8 as illustrated in FIG. 5B. With the rearrangement of the installation position of the process cartridge 6S (the developing device 5S) for special color, the installation position of the process cartridge 6K (the developing device 5K) for black is replaced with the installation position of the process cartridge 6S (the developing device 5S). With such a rearrangement of the installation position of the process cartridges 6S and 6K (the developing devices 5S and 5K), the toner container 32S and the developer supply device 90S for special color, and the toner container 32K and the developer supply device 90K for black are swapped.

Users or service engineers manually performs the rearrangement operation according to procedures displayed on a control panel disposed on the exterior of the image forming apparatus 100.

Such a rearrangement of the process cartridge 6K (the developing device 5K), the toner container 32K, and the developer supply device 90K for black and the process cartridge 6S (the developing device 5S), the toner container 32S, and the developer supply device 90S for special color is described in more detail later.

Referring to FIG. 2, the process cartridge 6Y for yellow is a removable single unit removably installed in the image forming apparatus 100 and includes the photoconductor drum 1Y as the image bearer and further includes a charger 4Y, the developing device 5Y, and a cleaner 2Y disposed around the photoconductor drum 1Y. Image forming processes, namely, charging, exposure, development, transfer, and cleaning processes are performed on the photoconductor drum 1Y, and thus a yellow toner image is formed on the photoconductor drum 1Y.

Note that the other process cartridges 6M, 6C, 6K, and 6S have configurations similar to the process cartridge 6Y for yellow except the color of the toner used therein and form magenta, cyan, black, and special color toner images, respectively. Thus, only the process cartridge 6Y is described below, and descriptions of the other process cartridges 6M, 6C, 6K, and 6S are omitted.

Referring to FIG. 2, the photoconductor drum 1Y as the image bearer is rotated counterclockwise indicated by arrow A2 in FIG. 2 by a driving motor. The charger 4Y uniformly charges a surface of the photoconductor drum 1Y at a position opposite the charger 4Y (a charging process).

When the surface of the photoconductor drum 1Y reaches a position to receive a laser beam L emitted from the exposure device 7Y (i.e., a writing device), the photoconductor drum 1Y is scanned with the laser beam L, and thus an electrostatic latent image for yellow is formed on the surface of the photoconductor drum 1Y (an exposure process).

Then, the surface of the photoconductor drum 1Y reaches a position facing the developing device 5Y (a developing roller 51), where the electrostatic latent image is developed with toner into a yellow toner image (a development process).

When the surface of the photoconductor drum 1Y carrying the toner image reaches a position facing a primary transfer roller 9Y via the intermediate transfer belt 8, the toner image on the photoconductor drum 1Y is transferred onto the intermediate transfer belt 8 as the intermediate transferor (a primary transfer process). After the primary transfer process, a certain amount of residual, untransferred toner remains on the photoconductor drum 1Y.

When the surface of the photoconductor drum 1Y reaches a position facing the cleaner 2Y, a cleaning blade 2*a* collects the untransferred toner from the photoconductor drum 1Y into the cleaner 2Y (a cleaning process).

Subsequently, the surface of the photoconductor drum 1Y reaches a position facing the discharger, and the discharger eliminates residual potential from the photoconductor drum 1Y.

Thus, a sequence of image forming processes performed on the photoconductor drum 1Y is completed.

The above-described image forming processes are performed in the process cartridges 6M, 6C, 6K, and 6S similarly to the process cartridge 6Y for yellow. That is, the exposure devices 7M, 7C, 7K, and 7S disposed above the process cartridges 6M, 6C, 6K, and 6S irradiate respective photoconductor drums 1M, 1C, 1K, and 1S of the process cartridges 6M, 6C, 6K, and 6S with the laser beams L based on image data. Specifically, the exposure devices 7 include light sources to emit the laser beams L, multiple optical elements, and a polygon mirror that is rotated by a motor. The laser beams L are directed to the respective photoconductor drums 1Y, 1M, 1C, 1K, and 1S via the multiple optical elements while being deflected by the polygon mirror.

Then, the toner images formed on the respective photoconductor drums 1Y, 1M, 1C, 1K, and 1S through the development process are primarily transferred and deposited one on another onto the intermediate transfer belt 8. Thus, a desired multicolor toner image is formed on the intermediate transfer belt 8.

In FIG. 1, the intermediate transfer device 15 includes the intermediate transfer belt 8 as the intermediate transferor, the five primary transfer rollers 9Y, 9M, 9C, 9K, and 9S, a driving roller, a secondary transfer backup roller, multiple tension rollers, a cleaning backup roller, and a belt cleaner. The intermediate transfer belt 8 (the intermediate transferor) is supported by and entrained around multiple rollers and rotates in the movement direction (clockwise) indicated by arrow A1 illustrated in FIG. 1 as one (the driving roller) of the multiple rollers rotates.

The five primary transfer rollers 9Y, 9M, 9C, 9K, and 9S are disposed facing the photoconductor drums 1Y, 1M, 1C, 1K, and 1S via the intermediate transfer belt 8, respectively. Specifically, the five primary transfer rollers 9Y, 9M, 9C, 9K, and 9S contact the photoconductor drums 1Y, 1M, 1C, 1K, and 1S, respectively, with the intermediate transfer belt 8 interposed therebetween, and form respective primary transfer nip regions. A primary transfer power source applies a primary transfer bias opposite to toner in polarity to the primary transfer rollers 9Y, 9M, 9C, 9K, and 9S.

While rotating in the direction indicated by arrow A1 in FIG. 1, the intermediate transfer belt 8 sequentially passes past the primary transfer nips between the photoconductor drums 1Y, 1M, 1C, 1K, and 1S and the respective primary transfer rollers 9Y, 9M, 9C, 9K, and 9S. With such an operation, respective toner images formed on the photoconductor drums 1Y, 1M, 1C, 1K, and 1S are sequentially transferred and deposited onto the surface of the intermediate transfer belt 8.

Thereafter, the yellow, magenta, cyan, black, and special color toner images superimposed on the intermediate transfer belt 8 reach a secondary transfer position where the intermediate transfer belt 8 faces a secondary transfer roller 19. The secondary transfer backup roller and the secondary transfer roller 19 press against each other via the intermediate transfer belt 8, and the contact portion therebetween is hereinafter referred to as a secondary transfer nip. The multicolor toner image on the intermediate transfer belt 8 is transferred onto a sheet P (a recording medium) conveyed to the secondary transfer nip (a secondary transfer process). At that time, residual toner that is untransferred onto the sheet P remains on the surface of the intermediate transfer belt 8.

Subsequently, the surface of the intermediate transfer belt 8 reaches a position facing the belt cleaner. The untransferred toner remaining on the intermediate transfer belt 8 is collected by the belt cleaner.

Thus, a sequence of image transfer processes performed on the intermediate transfer belt 8 is completed.

Referring back to FIG. 1, the sheet P is transported from a sheet feeder 26 (specifically, a sheet tray) disposed in a lower portion of the image forming apparatus 100 to the secondary transfer nip through a sheet feeding path K1, along which a sheet feeding roller 27 and a registration roller pair 28 are disposed.

Specifically, the sheet feeder 26 contains a stack of multiple sheets P piled one on another. The sheet feeding roller 27 rotates counterclockwise in FIG. 1 to feed the sheet P on the top of the stack in the sheet feeder 26 toward a nip of the registration roller pair 28.

The registration roller pair 28 (timing roller pair) temporarily stops rotating, stopping the sheet P with a leading edge of the sheet P nipped in the registration roller pair 28. The registration roller pair 28 resumes rotation to convey the sheet P to the secondary transfer nip, timed to coincide with the arrival of the multicolor toner image on the intermediate transfer belt 8. Accordingly, a desired color image is transferred onto the sheet P.

Thereafter, the sheet P onto which the multicolor toner image is transferred at the secondary transfer nip is conveyed to a fixing device 20. In the fixing device 20, a fixing belt and a pressing roller apply heat and pressure to the sheet P to fix the multicolor toner image on the sheet P (a fixing process).

Subsequently, the sheet P is conveyed through an ejection path K2 and ejected by a pair of ejection roller pair to the outside of the image forming apparatus 100. The sheets P are sequentially stacked as output images on a stack tray.

Thus, a series of image forming processes performed by the image forming apparatus 100 is completed.

Next, a configuration and operation of the developing device 5Y of the process cartridge 6Y are described in further detail below with reference to FIG. 2.

A casing of the developing device 5Y to contain the developer G is divided, at least partially, into two developer containing compartments. The developing device 5Y includes a developing roller 51 as a developer bearer disposed facing the photoconductor drum 1Y, a doctor blade 52 disposed facing the developing roller 51, two conveying screws 55 respectively disposed in the developer containing compartments, a density sensor 56 to detect concentration (percentage) of toner in developer G or toner density, and an opening 57 for supplying toner (developer) to the developer containing compartment. The developing roller 51 includes stationary magnets, a sleeve that rotates around the magnets, and the like. The developer containing compartments contain two-component developer G including carrier (carrier particles) and toner (toner particles).

The developing device 5Y operates as follows.

The sleeve of the developing roller 51 rotates in a direction indicated by arrow A3 illustrated in FIG. 2. The developer G is carried on the developing roller 51 by a magnetic field generated by the magnets. As the sleeve rotates, the developer G moves along a circumference of the developing roller 51.

The percentage (concentration) of toner in the developer G (ratio of toner to carrier) in the developing device 5Y is adjusted within a predetermined range. Specifically, according to the consumption of toner in the developing device 5Y, the developer supply device 90Y (illustrated in FIG. 3) supplies toner (i.e., powder) from the toner container 32Y (the developer container) to the developing device 5Y (the developer containing compartment in particular). A configuration and operation of the toner container 32Y and the developer supply device 90Y are described in further detail later.

While being stirred with the developer G and circulated by the two conveying screws 55 in the developing device 5Y (the developer containing compartments), the supplied toner is circulated between the two developer containing compartments in a longitudinal direction of the developing device 5Y, which is perpendicular to the surface of the paper on which FIG. 2 is drawn. The toner in two-component developer G is charged by friction with carrier and electrostatically attracted to the carrier. The toner is carried on the developing roller 51 together with the carrier by magnetic force generated on the developing roller 51.

The developer G carried on the developing roller 51 is transported in the clockwise direction indicated by arrow A3 in FIG. 2 to the doctor blade 52. The amount of developer G on the developing roller 51 is adjusted by the doctor blade 52, after which the developer G is carried to a developing range facing the photoconductor drum 1Y. The toner in the developer G is attracted to the electrostatic latent image formed on the photoconductor drum 1Y due to the effect of an electric field generated in the developing range. As the sleeve rotates, the developer G remaining on the developing roller 51 reaches an upper part of the developer containing compartment, drops from the developing roller 51, and returns to the developer containing compartment.

The above-described electric field generated in the developing range is formed by potential difference between the exposure potential (the latent image potential) formed on the photoconductor drum 1Y by emission of the laser beam L and a development bias applied to the developing roller 51 by a development power supply.

Next, a configuration and operation of the developer supply device 90Y for yellow illustrated in FIG. 3 is described.

In the present embodiment, the four other developer supply devices (the developer supply device 90M for magenta, the developer supply device 90C for cyan, the developer supply device 90K for black, and the developer supply device 90S for special color) have substantially the same configuration as the developer supply device 90Y for yellow, except that the color (type) of the toner to be used is different. Therefore, descriptions of the developer supply devices 90M, 90C, 90K, and 90S are appropriately omitted, and only the developer supply device 90Y for yellow is described.

The developer supply device 90Y rotates the toner container 32Y as the developer container installed in a toner container mount 31 in a predetermined direction (direction indicated by arrow A4 in FIG. 3), discharges the toner contained in the toner container 32Y to the outside of the toner container 32Y, and guides the toner to the developing device 5Y, thereby forming a toner supply route (a toner transport route).

In FIG. 3, the arrangement direction of the toner container 32Y, the developer supply device 90Y, and the developing device 5Y are changed for ease of understanding. In the present embodiment, the long axis of the toner container 32Y and a part of the developer supply device 90Y are perpendicular to the surface of the paper on which FIG. 3 is drawn (see FIG. 1). In addition, the orientation and arrangement of a tube 95 (conveyance path) are also illustrated in a simplified manner.

The yellow toner contained in the toner container 32Y installed in the toner container mount 31 of the image forming apparatus 100 is supplied to the developing device 5Y by the developer supply devices 90Y according to an amount of toner consumed in the developing device 5Y.

Specifically, when the toner container 32Y is set in the toner container mount 31 of the image forming apparatus 100, a bottle gear 37 of the toner container 32Y meshes with the driving gear 110 of the image forming apparatus 100, and a cap chuck 92 of a cap holder 91 removes a cap 34, which is for closing a toner outlet C, from the toner container 32Y. Accordingly, the toner outlet C of the toner container 32Y is opened, and the yellow toner is discharged from the toner container 32Y through the toner outlet C.

In the developer supply device 90Y, a reservoir 81 is disposed below the toner outlet C via a downward path 82. A suction port 83 is disposed in the bottom portion of the reservoir 81, and the suction port 83 is coupled to one end of the tube 95 (conveyance path) via a nozzle. The tube 95 as the conveyance path is formed of a flexible material with low affinity for toner, and the other end of the tube 95 is coupled to the conveyance pump 60 (diaphragm pump). The conveyance pump 60 is coupled to the developing device 5Y via a sub-hopper 70 and a conveyance pipe 98.

With such a configuration of the developer supply device 90Y, as the driving gear 110 is driven by the drive motor 115, a container body 33 of the toner container 32Y is rotated in a predetermined direction, thereby discharging toner from the toner outlet C of the toner container 32Y. Accordingly, toner discharged from the toner outlet C of the toner container 32Y falls through the downward path 82 and is stored in the reservoir 81. As the conveyance pump 60 is operated, the toner stored in the reservoir 81 is sucked from the suction port 83 and is transported to the conveyance pump 60 and to the sub-hopper 70 via the tube 95. The toner transported to the sub-hopper 70 is supplied into the developing device 5Y via the conveyance pipe 98 extending in the vertical direction. That is, the toner in the toner container 32Y is transported in the direction indicated by dashed arrows A5 in FIG. 3. In the present embodiment, unlike the tube 95, the conveyance pipe 98 that couples the sub-hopper 70 and the developing device 5Y is formed of a hard resin material or a metal material which is hardly deformed.

Next, the conveyance pump 60 and the sub-hopper 70 of the developer supply device 90Y are described in detail with reference to FIG. 4.

In the present embodiment, the conveyance pump 60 forms a single unit including the sub-hopper 70.

Figure 4:
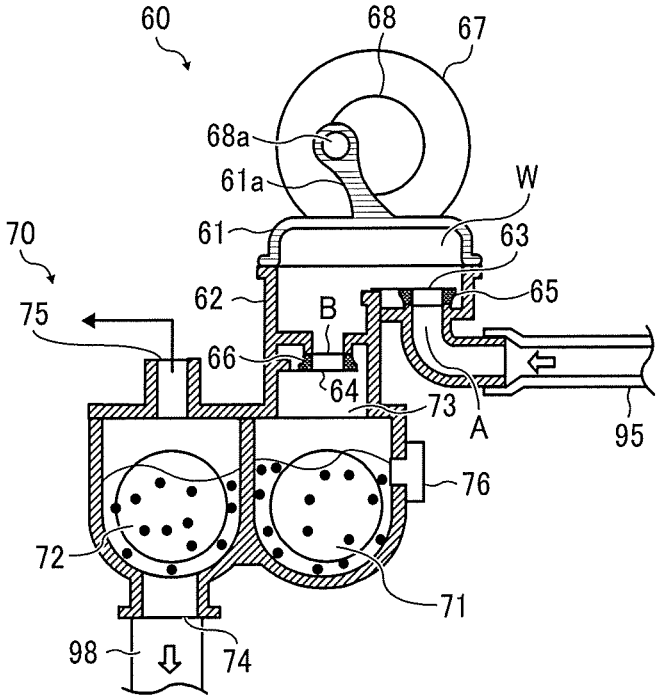
FIG. 4 is a cross-sectional view of a conveyance pump and a sub-hopper of the developer supply device in FIG. 3.

Referring to FIG. 4, the conveyance pump 60 in the present embodiment is a diaphragm pump (a positive displacement pump) and includes a diaphragm 61 (a rubber member), a case 62, a motor 67, a rotary plate 68, an inlet check valve 63 and an outlet check valve 64, seals 65 and 66 (elastic members), and the like. The conveyance pump 60 with such a configuration is relatively small and low in cost.

The case 62 and the diaphragm 61 together form the body of the conveyance pump 60.

The case 62 is made of a resin material or a metal material having good rigidity and functions as a main part (housing) of the body of the conveyance pump 60. An inlet A for bringing the developer together with air into the interior and an outlet B for discharging the developer together with air from the interior are disposed in the case 62 (a pump body).

The diaphragm 61 is made of a rubber material having elasticity and a low affinity for toner. The interior of the bowl-like portion functions as a variable volume portion W, and an arm 61*a* stands on the periphery thereof. An eccentric shaft 68*a* of the rotary plate 68 engages a hole of the arm 61*a*. The diaphragm 61 is joined with the case 62 without a gap, and the variable volume portion W of the diaphragm 61 and the inside of the case 62 are formed as one closed space inside the body of the conveyance pump 60 (i.e., the pump body). The diaphragm 61 expands and contracts by the rotary plate 68 (the eccentric shaft 68*a*) to be described later, thereby increasing and decreasing the internal volume. Therefore, the body of the conveyance pump 60 (i.e., the diaphragm 61 and the case 62) alternately generate positive pressure and negative pressure.

The rotary plate 68 is disposed on the motor shaft of the motor 67, and the eccentric shaft 68*a* is provided on the surface of the rotary plate 68 so as to stand upright at a position offset from the motor shaft (rotational center). The eccentric shaft 68*a* of the rotary plate 68 is inserted (fitted) into the hole formed in a tip of the arm 61*a* of the diaphragm 61.

With such a configuration, as the motor 67 is driven by a controller 120, the rotary plate 68 (the eccentric shaft 68*a*) rotates. Accordingly, the diaphragm 61 expands and contracts so as to increase and decrease the volume of the variable volume portion W periodically. With such expansion and contraction of the diaphragm 61, the positive pressure and the negative pressure are alternately generated inside the pump body composed of the diaphragm 61 and the case 62.

The inlet check valve 63 is disposed at the inlet A of the pump body (the case 62). The inlet check valve 63 opens the inlet A when the negative pressure is generated inside the pump body (the diaphragm 61 and the case 62) and closes the inlet A when the positive pressure is generated inside the pump body. The inlet check valve 63 is provided to face the inlet A from the inside of the pump body. The reservoir 81 is coupled to the inlet A of the conveyance pump 60 via the tube 95.

On the other hand, the outlet check valve 64 is disposed at the outlet B of the pump body (the case 62). The outlet check valve 64 closes the outlet B when the negative pressure is generated inside the pump body and opens the outlet B when the positive pressure is generated inside the pump body. The outlet check valve 64 is provided to face the outlet B from the outside of the pump body. The sub-hopper 70 is coupled to the outlet B of the conveyance pump 60.

With such a configuration and operation, as described above with reference to FIG. 3, as the conveyance pump 60 operates, the toner stored in the reservoir 81 is sucked from the suction port 83 and conveyed into the sub-hopper 70 through the tube 95. Specifically, when a hopper sensor 76 of the sub-hopper 70 detects a shortage of toner in the sub-hopper 70, the conveyance pump 60 (the motor 67) is driven to supply toner from the reservoir 81 to the sub-hopper 70.

When the hopper sensor 76 detects that the amount of toner in the sub-hopper 70 has not reached a predetermined amount and an insufficient state is detected, similarly to the known one, the conveyance pump 60 (the motor 67) is intermittently driven in short cycles. As a result, the amount of toner conveyed by a first conveyance screw 71 and a second conveyance screw 72 in the sub-hopper 70 can catch up with the amount of toner supplied from the conveyance pump 60, thereby preventing toner from stagnating in a part of the sub-hopper 70.

Referring to FIG. 4, the first conveyance screw 71, the second conveyance screw 72, the hopper sensor 76, a supply motor 121 (see FIG. 3), and the like are provided in the sub-hopper 70. A supply port 73 communicating with the outlet B of the conveyance pump 60 is disposed above an upstream side of a first conveying path of the sub-hopper 70 in the direction of conveyance of toner. The first conveyance screw 71 is disposed in the first conveying path. A discharge port 74 is disposed under a downstream side of a second conveying path of the sub-hopper 70 in the direction of conveyance of toner and communicates with the developing device 5Y via the conveyance pipe 98. The second conveyance screw 72 is disposed in the second conveying path. An exhaust port 75 for discharging air fed together with the toner from the conveyance pump 60 is disposed above the second conveying path of the sub-hopper 70.

As described above, the hopper sensor 76 detects the insufficient state in which the amount of toner (developer) contained in the sub-hopper 70 is below the predetermined amount.

In the sub-hopper 70, a downstream side of the first conveying path and an upstream side of the second conveying path in the direction of conveyance of toner communicate with each other (i.e. a communicating portion) on one end side in the longitudinal direction of the sub-hopper 70 perpendicular to the surface of the paper on which FIGS. 3 and 4 are drawn. The first conveying path and the second conveying path are separated each other by a wall except the communicating portion.

The toner supplied into the sub-hopper 70 is conveyed through the first conveying path and the second conveying path in the sub-hopper 70 by the first conveyance screw 71 and the second conveyance screw 72 rotated by the supply motor 121 and is supplied to the developing device 5Y via the conveyance pipe 98. Specifically, when the density sensor 56 of the developing device 5Y detects a shortage of the toner concentration in the developer containing compartment (a circulation path in which the conveying screw 55 circulates the toner), the controller 120 rotates the first conveyance screw 71 and the second conveyance screw 72 of the sub-hopper 70, thereby supplying the toner from the sub-hopper 70 to the developing device 5Y.

As described above, in the present embodiment, the conveyance path extending from the reservoir 81 to the conveyance pump 60 is formed with the flexible tube 95. Therefore, even when various components are installed in the space between the reservoir 81 and the conveyance pump 60, the tube 95 can be installed avoiding those components to secure the conveyance path. Therefore, the toner container mount 31 of the toner container 32Y can be freely laid out at a position away from the developing device 5Y.

Next, referring to FIG. 3, configurations of the toner container 32Y and the developer supply device 90Y are described below.

As described above, the toner container 32Y includes the container body 33 and the cap 34 detachably attachable to a toner outlet C of the container body 33.

A bottle gear 37 that rotates together with the container body 33 and the toner outlet C are disposed on a head portion of the container body 33. The bottle gear 37 meshes with the driving gear 110 of the image forming apparatus 100, and the driving gear 110 rotates the container body 33 with the bottle gear 37 in a predetermined direction. The toner outlet C is for discharging toner (powder) from the container body 33 to the downward path 82.

The container body 33 includes a helical protrusion 33*a* protruding inward from an outer circumferential face to an inner circumferential face of the container body 33. In other words, a helical groove is provided in the outer circumferential face of the container body 33. The helical protrusion 33*a* is for discharging toner from the container body 33 through the toner outlet C of the toner container 32Y by rotation of the container body 33.

The container body 33 can be produced together with the bottle gear 37 as a single unit by blow molding.

Referring to FIG. 3, the cap holder 91 of the developer supply device 90Y covers the head portion of the toner container 32Y installed in the toner container mount 31 (the developer supply device 90Y).

The cap holder 91 includes the cap chuck 92 for opening and closing the cap 34 in conjunction with the installation and removal operation of the toner container 32Y and an opening-closing driver for driving the cap chuck 92. The cap holder is a part of the reservoir 81 as well as the downward path 82. As the toner container 32Y mounted on the toner container mount 31 is slid toward the cap holder 91 and the cap 34 reaches a position of the cap chuck 92, the opening-closing driver operates so that the cap 34 is separated from the toner outlet C in a state in which the cap chuck 92 holds the cap 34 in conjunction with an operation of the toner container 32Y that is slid further and pushed in. Thus, the toner outlet C of the toner container 32Y is opened, and toner can be discharged from the toner outlet C. Further, in conjunction with the installation operation of the toner container 32Y, the locking mechanism is operated to lock the head portion of the toner container 32Y so as not to be removed from the toner container mount 31. At that time, the toner container 32Y is secured to the developer supply device 90Y (the toner container mount 31) so that the toner outlet C side (head) of the toner container 32Y is rotatable, and the container body 33 is rotatably supported on the toner container mount 31.

In removal of the toner container 32Y from the toner container mount 31, the above-described processes are performed in reverse.

Toner discharged from the toner container 32Y drops through the downward path 82 to the bowl-shaped reservoir 81 of the developer supply device 90Y and stored therein. The reservoir 81 includes a toner sensor 86 and a stirrer. The conveyance pump 60 coupled to the suction port 83 of the reservoir 81 via the tube 95 sucks the toner in the reservoir 81 and conveys the toner through the tube 95.

As described above, in the present embodiment, the toner discharged from the toner container 32Y is not directly sucked by the conveyance pump 60 but is stored in the reservoir 81 to some extent. Then, the conveyance pump 60 sucks the necessary amount of toner. Accordingly, such a configuration can minimize shortage of the toner sucked by the conveyance pump 60.

The toner sensor 86 is disposed near the suction port 83 and indirectly detects a state in which the toner contained in the toner container 32Y is depleted (toner depletion), or a state close thereto (toner near depletion). The toner is discharged from the toner container 32Y based on the detection result of the toner sensor 86.

For example, a piezoelectric sensor or a light transmission sensor can be used as the toner sensor 86. In the present embodiment, the piezoelectric sensor is used as the toner sensor 86. The height of the detection surface of the toner sensor 86 is set so that the amount of toner (deposition height) deposited above the suction port 83 is a target value.

Based on the detection result of the toner sensor 86, the controller 120 controls a drive timing and a drive duration of the drive motor 115 to rotationally drive the toner container 32Y (the container body 33). Specifically, when the controller 120 determines that there is no toner at the detection position based on the detection result of the toner sensor 86, the drive motor 115 is driven for a predetermined time. On the other hand, when the controller 120 determines that the toner is present at the detection position based on the detection result of the toner sensor 86, the drive motor 115 is stopped.

Next, referring to FIGS. 5A to 6, the configuration and operation of the image forming apparatus 100 according to the first embodiment are described below.

In the image forming apparatus 100 according to the first embodiment, the plurality of developing devices 5Y, 5M, 5C, 5K, and 5S; the plurality of toner containers 32Y, 32M, 32C, 32K, and 32S (the plurality of developer containers); and the plurality of developer supply devices 90Y, 90M, 90C, 90K, and 90S can be rearranged for each color in the movement direction of the intermediate transfer belt 8 in a manner that the developing device 5, the toner container 32, and the developer supply device 90 for each color are separately detached from the installation position and divided into respective units.

That is, the developing devices 5Y, 5M, 5C, 5K, and 5S (the process cartridges 6Y, 6M, 6C, 6K, and 6S); the toner containers 32Y, 32M, 32C, 32K, and 32S; and the developer supply devices 90Y, 90M, 90C, 90K, and 90S are not rearranged with the combination of the developing device 5, the toner container 32, and the developer supply device 90 for the same color at a time. The developing device 5, the toner container 32, and the developer supply device 90 are divided into respective units at (decoupled from) the installation position, moved from the installation position to a new installation position, and coupled to each other again at the new installation position. Thus, the rearrangement of the developing devices 5Y, 5M, 5C, 5K, and 5S (the process cartridges 6Y, 6M, 6C, 6K, and 6S); the toner containers 32Y, 32M, 32C, 32K, and 32S; and the developer supply devices 90Y, 90M, 90C, 90K, and 90S is completed.

The developing device 5, the toner container 32, and the developer supply device 90 are relatively small units, respectively. However, the combination of the developing device 5, the toner container 32, and the developer supply device 90 becomes large, causing the rearrangement to be difficult. In the first embodiment, since the arrangement can be changed in the manner that each of the developing device 5, the developer container 32, and the developer supply device 90 corresponding to each color of the different colors is detached from and attached to the image forming apparatus 100, separately from a rest of the developing device 5, the developer container 32, and the developer supply device 90, the arrangement can be easily changed.

On the other hand, when the developing device 5, the toner container 32, and the developer supply device 90 are divided into the respective units at (decoupled from) the installation position, moved from the installation position to a new installation position, and coupled to each other again at the new installation position, the misarrangement of the developing devices 5, the toner containers 32, and the developer supply devices 90 may occur. In the misarrangement, toners of different colors mix in the developing device 5, and an undesired image with mixed color may be formed.

In the image forming apparatus 100 according to the first embodiment, in the case of rearrangement of the plurality of developing devices 5Y, 5M 5C, 5K, and 5S; the plurality of toner containers 32Y, 32M, 32C, 32K, and 32S (the plurality of developer containers); and the plurality of developer supply devices 90Y, 90M, 90C, 90K, and 90S in the movement direction of the intermediate transfer belt 8, the image forming apparatus 100 can be used only when the colors of the developing device 5, the toner container 32, and the developer supply device 90 rearranged in the manner described above correspond to each other at the same installation position.

Figure 5C:
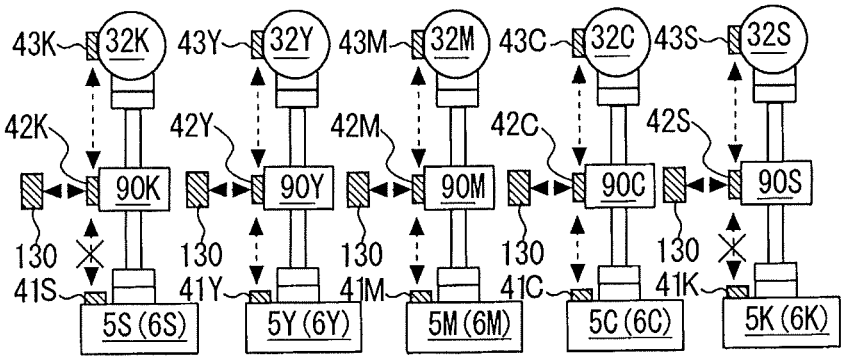
FIG. 5C is a block diagram illustrating the arrangement of components of the image forming apparatus according to the first embodiment when the components are misarranged in FIG. 5B.

Specifically, in the case of rearrangement from a basic arrangement illustrated in FIG. 5A (in the order of special color, colors, and black from the left) to an arrangement illustrated in FIG. 5B (in the order of black, colors, and special color from the left), if the arrangement (color combination) is inconsistent as illustrated in FIG. 5C, the controller 120 prohibits the image forming apparatus 100 from forming images (printing operation).

In FIG. 5C, for example, the toner container 32K and the developer supply device 90K for black, and the toner container 32S and the developer supply device 90S for special color are swapped, but the developing device 5K (the process cartridge 6K) for black and the developing device 5S (the process cartridge 6S) for special color is not swapped instead of swapping all units for black and for special color. That is, the color combinations are inconsistent at the extreme upstream installation position and the extreme downstream installation position in the movement direction of the intermediate transfer belt 8.

More specifically, as illustrated in FIGS. 5A to 5C, the plurality of developing devices 5Y, 5M 5C, 5K, and 5S; the plurality of toner containers 32Y, 32M, 32C, 32K, and 32S; and the plurality of developer supply devices 90Y, 90M, 90C, 90K, and 90S include radiofrequency identifiers (RFIDs) 41Y to 43Y, 41M to 43M, 41C to 43C, 41K to 43K, and 41S to 43S as storage devices to store color data in the divided units, respectively.

Specifically, the RFIDs 41Y, 41M, 41C, 41K, and 41S to store the color data are attached to the five developing devices 5Y, 5M, 5C, 5K, and 5S, respectively. The RFID 41K of the developing device 5K for black stores the color data that color to be used is black, the RFID 41Y of the developing device 5Y for yellow stores the color data that color to be used is yellow, the RFID 41M of the developing device 5M for magenta stores the color data that color to be used is magenta, the RFID 41C of the developing device 5C stores the color data that color to be used is cyan, and the RFID 41S of the developing device 5S for special color stores the color data that color to be used is special color. Note that, the RFID 41S for special color stores a specific color (e.g., clear, white, or the like).

Similarly to the developing devices 5, the RFIDs 42Y, 42M, 42C, 42K, and 42S to store the color data are attached to the five developer supply devices 90Y, 90M, 90C, 90K, and 90S, respectively. In addition, the RFIDs 43Y, 43M, 43C, 43K, and 43S to store the color data are attached to the five toner containers 32Y, 32M, 32C, 32K, and 32S, respectively.

The color data can be written to the RFIDs 41Y to 43Y, 41M to 43M, 41C to 43C, 41K to 43K, and 41S to 43S at factory shipment. The RFIDs 41Y to 43Y, 41M to 43M, 41C to 43C, 41K to 43K, and 41S to 43S can store data other than color (for example, production lot, operation time, presence or absence of recycling, and the like).

In the image forming apparatus 100, readers 130 directly or indirectly communicate with the RFIDs 41Y to 43Y, 41M to 43M, 41C to 43C, 41K to 43K, and 41S to 43S to read the color data stored in the RFIDs 41Y to 43Y, 41M to 43M, 41C to 43C, 41K to 43K, and 41S to 43S.

Specifically, in the first embodiment, the readers 130 are disposed at five installation positions at which the readers 130 can communicate with the RFIDs 42Y, 42M, 42C, 42K, and 42S. In addition, the RFIDs 42Y, 42M, 42C, 42K, and 42S of the developer supply devices 90 communicate with the RFIDs 41Y, 41M, 41C, 41K, and 41S of the developing devices 5 and the RFIDs 43Y, 43M, 43C, 43K, and 43S of the toner container 32, respectively.

With such a configuration, the readers 130 at respective installation positions directly read the color data stored in the RFIDs 42Y, 42M, 42C, 42K, and 42S of the developer supply devices 90 and indirectly read the color data stored in the RFIDs 41Y, 41M, 41C, 41K, and 41S of the developing devices 5 and the RFIDs 43Y, 43M, 43C, 43K, and 43S of the toner containers 32 via the RFIDs 42Y, 42M, 42C, 42K, and 42S of the developer supply devices 90. As the readers 130 reads the color data, the controller 120 can determine a state in which the color combination is consistent at each installation position as illustrated in FIG. 5A and 5B or a state in which the color combination is inconsistent as illustrated in FIG. 5C. The controller 120 allows the image forming apparatus 100 to form images only when all the color combinations are consistent based on the color data read by the reader 130.

In the image forming apparatus 100 according to the first embodiment, in the case of rearrangement of the plurality of developing devices 5Y, 5M 5C, 5K, and 5S; the plurality of toner containers 32Y, 32M, 32C, 32K, and 32S; and the plurality of developer supply devices 90Y, 90M, 90C, 90K, and 90S, the image forming apparatus 100 can be used only when the controller 120 determines the state in which colors of the developing device 5, the toner container 32, and the developer supply device 90 rearranged in the manner correspond to each other at each installation position, based on the color data read from the RFID by the reader 130.

As described above, the image forming apparatus 100 according to the first embodiment can be used only when the color combination of the developing device 5, the toner container 32, and the developer supply device 90 rearranged in the manner is consistent. Therefore, when the arrangement of the plurality of toner containers 32 and the plurality of developer supply devices 90 are changed together to rearrange the plurality of developing devices 5, the problem that toners of different colors mix in the developing device 5 due to the misarrangement does not occur.

In the first embodiment, non-contact RFIDs 41Y to 43Y, 41M to 43M, 41C to 43C, 41K to 43K, and 41S to 43S as the storage devices to store color data and non-contact type reader 130 as a reading device corresponding to the storage device are used. The storage device and the reading device are not limited to the above-described devices. Alternatively, contact type nonvolatile memory or identification (ID) chip as the storage device and a contact type reader as the corresponding reading device can be used. Chip to store a plurality of color data by a combination of on and off of a plurality of dual in-line package (DIP) switches and firmware to read and identify chip data as the corresponding reading device can be used.

In the first embodiment, one reader 130 at each installation position can indirectly read the color data stored in the RFID 41 of the developing device 5 and the RFID 43 of the toner container 32 via the RFID 42 of the developer supply device 90. Alternatively, a plurality of readers can separately read the color data stored in the RFIDs 41 of the developing devices 5, the RFIDs 43 of the toner containers 32, and the RFIDs 42 of the developer supply devices 90.

Referring to FIG. 3, the image forming apparatus 100 according to the first embodiment includes a memory 125 as an apparatus side storage device to store data concerning color arrangement in the case of rearrangement of the plurality of developing devices 5Y, 5M 5C, 5K, and 5S; the plurality of toner containers 32Y, 32M, 32C, 32K, and 32S; and the plurality of developer supply devices 90Y, 90M, 90C, 90K, and 90S.

Specifically, the memory 125 (the apparatus side storage device) stores an arrangement data that the arrangement as illustrated in FIG. 5A is adopted in the case of clear toner as the special color and the arrangement as illustrated in FIG. 5B is adopted in the case of white toner as the special color.

In the image forming apparatus 100 according to the first embodiment, in the case of rearrangement of the plurality of developing devices 5Y, 5M 5C, 5K, and 5S; the plurality of toner containers 32Y, 32M, 32C, 32K, and 32S; and the plurality of developer supply devices 90Y, 90M, 90C, 90K, and 90S, if the controller 120 determines the state in which colors of the developing device 5, the toner container 32, and the developer supply device 90 rearranged in the manner correspond to each other, based on the color data read from the RFIDs 41Y to 43Y, 41M to 43M, 41C to 43C, 41K to 43K, and 41S to 43S (the storage devices) by the reader 130, and the color arrangement is different from the data concerning color arrangement (the arrangement data) stored in the memory 125 (apparatus side storage device), the image forming apparatus 100 can be used only when the data concerning color arrangement (the arrangement data) stored in the memory 125 is rewritten by a user's selection.

Specifically, when the developing device 5K (the process cartridge 6K), the toner container 32K, and the developer supply device 90K for black and the developing device 5S (the process cartridge 6S), the toner container 32S, and the developer supply device 90S for special color (white) are tried to be swapped and the arrangement data as illustrated in FIG. 5B is stored in the memory 125, if the developing devices 5 (the process cartridges 6), the toner containers 32, and the developer supply devices 90 are arranged differently from the arrangement data as illustrated in FIG. 5A (limited to the arrangement in which the color combination is consistent), the controller 120 does not constantly prohibit image formation. If a user permits the arrangement different from the arrangement data, the controller 120 allows the image forming apparatus to form images under the condition that the arrangement data stored in the memory 125 is rewritten to the permitted arrangement.

That is, when the color combination of the arrangement is consistent, but the color arrangement is different from the arrangement data stored in the memory 125 (the image forming apparatus 100), the user can determine whether to rewrite the arrangement data and permit the image forming apparatus to form images. In such a case, the user rewrites the arrangement data in the memory 125 according to an operation guide displayed on the control panel disposed on the exterior of the image forming apparatus 100.

Such a configuration gives flexibility to select image formation operations to a user who prioritizes speed of image output over maximum image quality.

Figure 6:
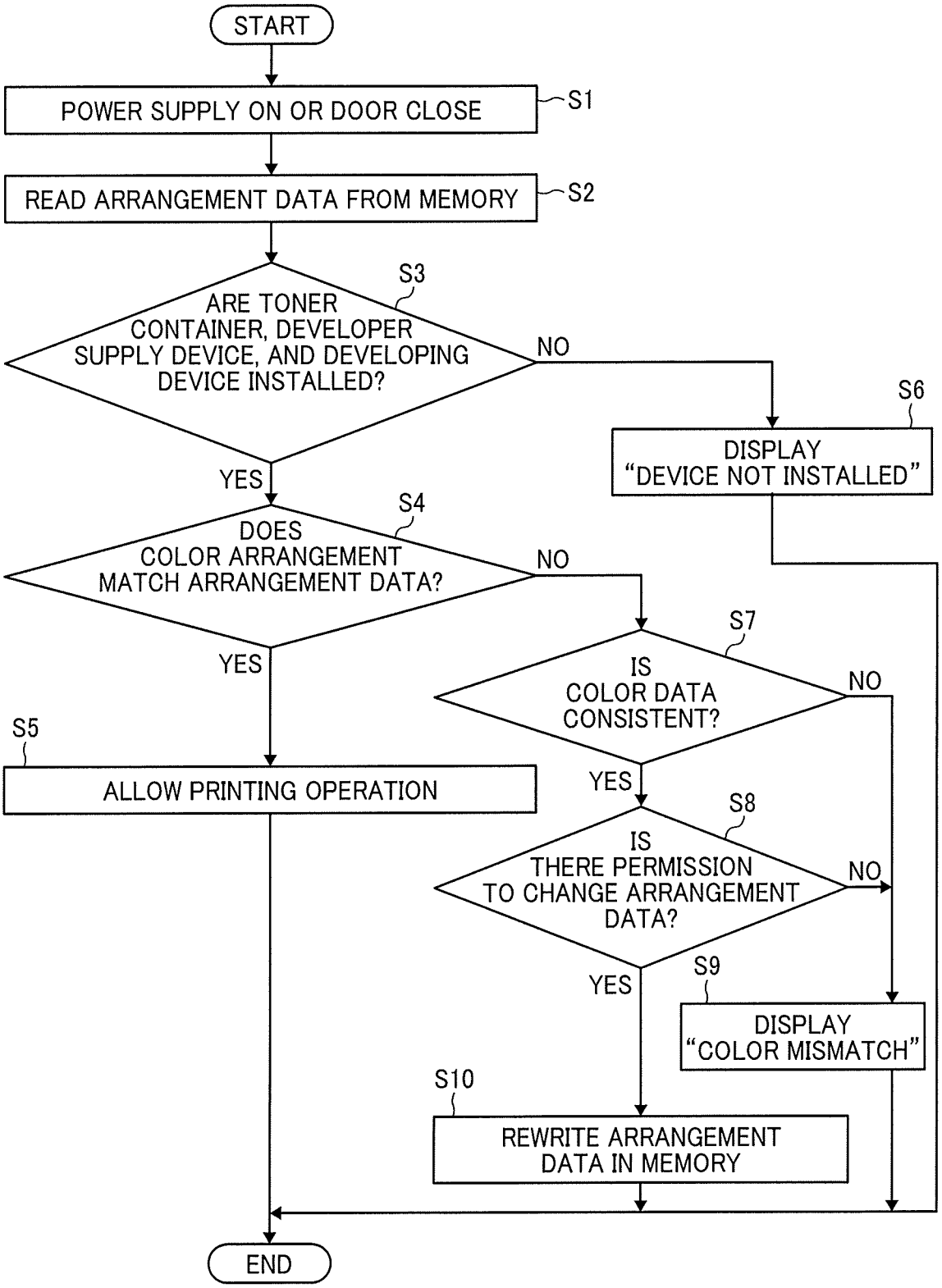
FIG. 6 is a flowchart illustrating processes to prevent misarrangement of toner containers, developer supply devices, and developing devices according to the first embodiment.

Referring to a flowchart illustrated in FIG. 6, description is provided of an example of control flow to prevent misarrangement of the toner containers 32, the developer supply devices 90, and the developing devices 5 according to the first embodiment.

As illustrated in FIG. 6, power supply of the image forming apparatus 100 is turned on or a door of the image forming apparatus 100 is closed (step S1). The controller 120 reads the arrangement data from the memory 125 using the above-described action in step S1 as a trigger (step S2). The controller 120 checks an installation state of the toner containers 32, the developer supply devices 90, and the developing devices 5 based on a detection result detected by a set detection sensor (step S3). As a result, if the set detection sensor detects that any one of the toner containers 32, the developer supply devices 90, and the developing devices 5 for five colors is not installed in the image forming apparatus 100, the controller 120 displays the detection result on the control panel (step S6). The controller 120 does not allow image formation until the installation state described above is resolved.

On the other hand, if the set detection sensor detects that all of the toner containers 32, the developer supply devices 90, and the developing devices 5 for five colors are installed in the image forming apparatus 100, the reader 130 reads the color data of the toner containers 32, the developer supply devices 90, and the developing devices 5 at the respective installation positions, and the controller 120 determines whether the color arrangement matches the arrangement data read in step S2 (step S4).

As a result, when the controller 120 determines that the color arrangement of the five toner containers 32, the five developer supply devices 90, and the five developing devices 5 matches the arrangement data read in step S2, the controller 120 assumes that images with fine image quality can be formed and allows printing operation of the image forming apparatus 100 (step S5). Then, the process in the flowchart in FIG. 6 ends.

On the other hand, when the controller 120 determines, in step S4, that the color arrangement of the toner containers 32, the developer supply devices 90, and the developing devices 5 for five colors does not match the arrangement data read in step S2, the controller 120 determines whether the color combination of the toner container 32, the developer supply device 90, and the developing device 5 is consistent (step S7).

As a result, if the controller 120 determines the color combination of the toner container 32, the developer supply device 90, and the developing device 5 is not consistent at least one installation position, color mixture occurs at the installation position, and the warning of color mismatch is displayed on the control panel (step S9). The controller 120 does not allow image formation until the inconsistent installation state is resolved.

On the other hand, if the controller 120 determines the color combinations of the five toner containers 32, the five developer supply devices 90, and the five developing devices 5 are consistent at all installation positions in step S7, color mixture does not occur. However, image quality may deteriorate due to different color arrangement. Accordingly, a message to confirm the presence or absence of change of the arrangement data is displayed on the control panel, and the controller 120 determines whether the change of the arrangement data is permitted (step S8). As a result, if the change of the arrangement data is not permitted, the process in step S9 is executed, and the process in the flowchart in FIG. 6 ends.

If the change of the arrangement data is permitted in step S8, the arrangement data stored in the memory 125 is rewritten to the arrangement data permitted to be changed (step S10), and the process in the flowchart in FIG. 6 ends. With such a condition, the controller 120 allows image formation.

As described above, in the case of rearrangement of the plurality of developing devices 5Y, 5M 5C, 5K, and 5S; the plurality of toner containers 32Y, 32M, 32C, 32K, and 32S (the plurality of developer containers); and the plurality of developer supply devices 90Y, 90M, 90C, 90K, and 90S in the movement direction of the intermediate transfer belt 8, the image forming apparatus 100 according to the first embodiment can be used only when the colors of the developing device 5, the toner container 32, and the developer supply device 90 rearranged in the manner described above correspond to each other.

Therefore, when the arrangement of the plurality of toner containers 32Y, 32M, 32C, 32K, and 32S and the plurality of developer supply devices 90Y, 90M, 90C, 90K, and 90S is changed together with the rearrangement of the plurality of developing devices 5Y, 5M 5C, 5K, and 5S, the problem that toners of different colors mix in the developing device 5 due to the misarrangement does not occur.

Second Embodiment

A second embodiment is described below with reference to FIGS. 7A to 9.

Figure 7A:
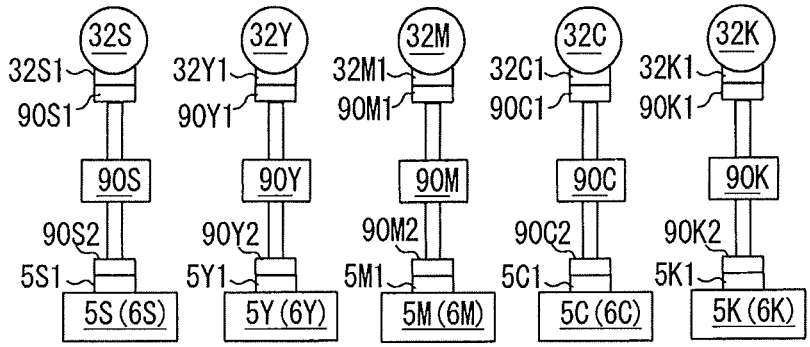
FIG. 7A is a block diagram illustrating the arrangement of components of the image forming apparatus according to a second embodiment when toner images are primarily transferred in the order of special color, colors, and black from the upstream side in the direction of movement of the intermediate transfer belt in the image forming apparatus.
Figure 7B:
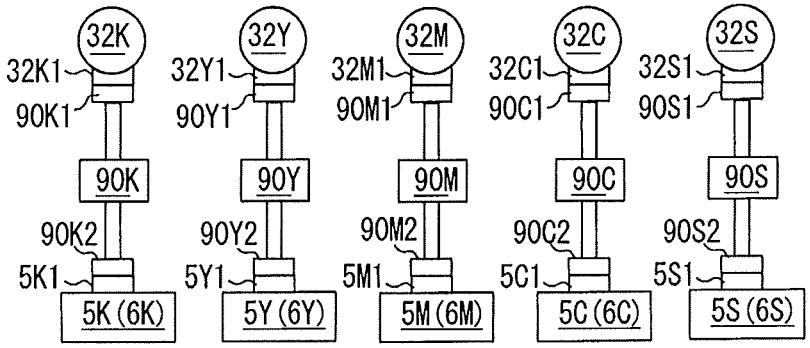
FIG. 7B is a block diagram illustrating the arrangement of components of the image forming apparatus according to the second embodiment when toner images are primarily transferred in the order of black, colors, and special color from the upstream side in the direction of movement of the intermediate transfer belt in the image forming apparatus.
Figure 7C:
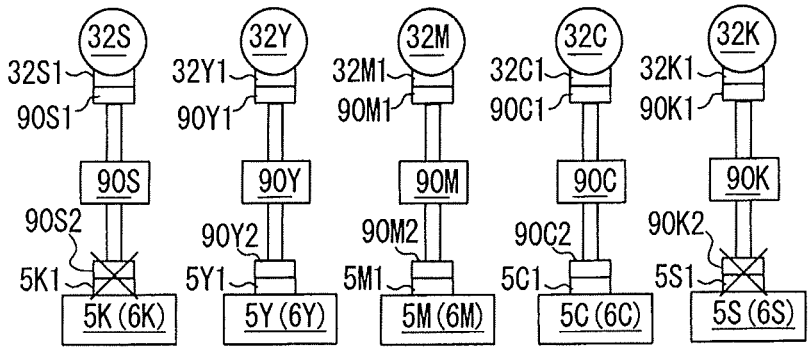
FIG. 7C is a block diagram illustrating the arrangement of components of the image forming apparatus according to the second embodiment when the components are misarranged in FIG. 7B.
Figure 8:
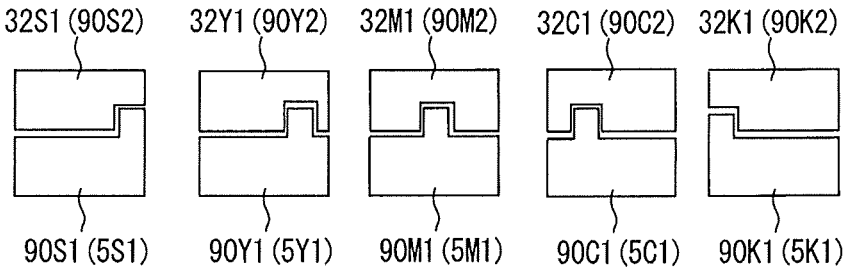
FIG. 8 is a schematic view illustrating a coupling portion having an incompatible shape for each color according to the second embodiment.

FIG. 7A is a block diagram illustrating the arrangement of components of the image forming apparatus 100 according to the second embodiment when toner images are primarily transferred in the order of special color, colors, and black from the upstream side in the movement direction of the intermediate transfer belt 8, corresponding to the FIG. 5A in the first embodiment. FIG. 7B is a block diagram illustrating the arrangement of components of the image forming apparatus 100 according to the second embodiment when toner images are primarily transferred in the order of black, colors, and special color from the upstream side in the movement direction of the intermediate transfer belt 8, corresponding to the FIG. 5B in the first embodiment. FIG. 7C is a block diagram illustrating the arrangement of components of the image forming apparatus 100 according to the second embodiment in the misarrangement, corresponding to the FIG. 5C in the first embodiment. FIG. 8 is a schematic view illustrating a coupling portion having an incompatible shape for each color.

The image forming apparatus 100 according to the second embodiment employs the coupling portion having the incompatible shape instead of the RFID in the first embodiment to prevent the misarrangement of the toner containers 32, the developer supply devices 90, and the developing devices 5.

As illustrated in FIGS. 7A to 8, in the second embodiment, the plurality of developing devices 5Y, 5M 5C, 5K, and 5S; the plurality of toner containers 32Y, 32M, 32C, 32K, and 32S (the plurality of developer containers); and the plurality of developer supply devices 90Y, 90M, 90C, 90K, and 90S include the coupling portions to be engaged in the manner that each of the developing device 5, the developer container 32, and the developer supply device 90 corresponding to each color of the different colors is detached from and attached to the image forming apparatus, separately from a rest of the developing device, the developer container, and the developer supply device, respectively.

More specifically, the coupling portions 5Y1, 5M1, 5C1, 5K1, and 5S1 of the five developing devices 5Y, 5M, 5C, 5K, and 5S engages with the coupling portions 90Y2, 90M2, 90C2, 90K2, and 90S2 of the five developer supply devices 90Y, 90M, 90C, 90K, and 90S, respectively.

Similarly, the coupling portions 32Y1, 32M1, 32C1, 32K1, and 32S1 of the five toner containers 32Y, 32M, 32C, 32K, and 32S engages with the coupling portions 90Y1, 90M1, 90C1, 90K1, and 90S1 of the five developer supply devices 90Y, 90M, 90C, 90K, and 90S, respectively.

As illustrated in FIG. 8, the coupling portion of each color has a recess or protrusion at different position, and the recess and the protrusion of the coupling portions for the same color engage with each other. Accordingly, the recess for a certain color and the protrusion for another color do not engage each other.

That is, in the case of rearrangement of the plurality of developing devices 5Y, 5M 5C, 5K, and 5S; the plurality of toner containers 32Y, 32M, 32C, 32K, and 32S (the plurality of developer containers); and the plurality of developer supply devices 90Y, 90M, 90C, 90K, and 90S in the movement direction of the intermediate transfer belt 8, the image forming apparatus 100 according to the second embodiment can be used only when coupling portions of the developing device 5, the toner container 32, and the developer supply device 90 rearranged in the manner engage with each other, and the colors of the developing device 5, the toner container 32, and the developer supply device 90 rearranged in the manner correspond to each other.

Specifically, in the case of rearrangement from the arrangement illustrated in FIG. 7A to the arrangement illustrated in FIG. 7B, all coupling portions correctly engage with each other, and all devices are normally installed in the image forming apparatus 100 when the color combinations of the developing devices 5, the toner containers 32, and the developer supply devices 90 are consistent at all installation positions. The set detection sensor detects a normal installation, and the image forming apparatus 100 can perform printing operation.

On the other hand, in the case of the arrangement illustrated in FIG. 7C instead of the arrangement illustrated in FIG. 7B, coupling portions indicated by X marks in FIG. 7C (between the coupling portions 5K1 and 90S2, and 5S1 and 90K2) do not correctly engage with each other. The set detection sensor detects an abnormal installation, and the image forming apparatus 100 is not allowed to perform image formation.

In the second embodiment, the coupling portions are detachably attached to the developing devices 5, the toner containers 32, and the developer supply devices 90 corresponding to the coupling portions, respectively.

Specifically, the coupling portions 5Y1, 5M1, 5C1, 5K1, and 5S1 are separate components from the developing devices 5K, 5Y, 5M, 5C, and 5S and detachably attached to the developing devices 5K, 5Y, 5M, 5C, and 5S with screws or the like.

Similarly, the coupling portions 90Y1, 90Y2, 90M1, 90M2, 90C1, 90C2, 90K1, 90K2, 90S1, and 90S2 are separate components from the developer supply devices 90K, 90Y, 90M, 90C, and 90S and detachably attached to the developer supply devices 90K, 90Y, 90M, 90C, and 90S.

The coupling portions 32Y1, 32M1, 32C1, 32K1, and 32S1 are separate components from the toner containers 32K, 32Y, 32M, 32C, and 32S and detachably attached to the toner containers 32K, 32Y, 32M, 32C, and 32S.

With such a configuration, the five developing devices 5Y, 5M 5C, 5K, and 5S; the five toner containers 32Y, 32M, 32C, 32K, and 32S; and the five developer supply devices 90Y, 90M, 90C, 90K, and 90S can be manufactured from common components except the coupling portions, respectively. Therefore, device cost can be reduced.

Figure 9:
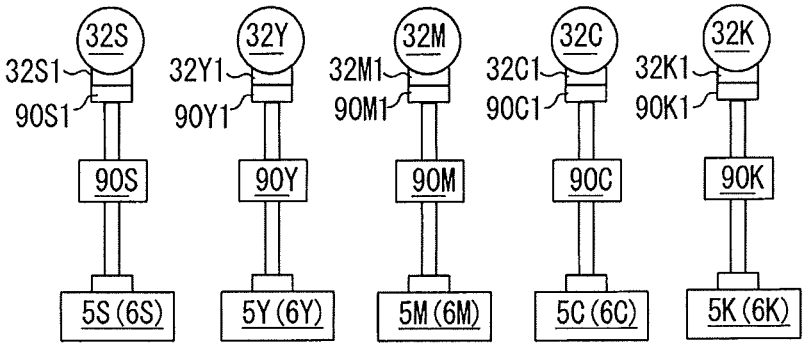
FIG. 9 is a block diagram illustrating the arrangement of components of the image forming apparatus according to a variation of the present disclosure when toner images are primarily transferred in the order of special color, colors, and black from the upstream side in the direction of movement of the intermediate transfer belt in the image forming apparatus.

FIG. 9 is a block diagram illustrating the arrangement of components of the image forming apparatus 100 according to a variation of the second embodiment when toner images are primarily transferred in the order of special color, colors, and black from the upstream side in the movement direction of the intermediate transfer belt 8, corresponding to the FIG. 7A in the second embodiment.

In the image forming apparatus 100 according to the variation, divided units in the rearrangement of the plurality of developing devices 5Y, 5M 5C, 5K, and 5S; the plurality of toner containers 32Y, 32M, 32C, 32K, and 32S; and the plurality of developer supply devices 90Y, 90M, 90C, 90K, and 90S are different from the divided units in the above-described second embodiment (or the first embodiment).

As illustrated in FIG. 9, the developing devices 5, the toner containers 32, and the developer supply devices 90 are rearranged in a state in which the developing device 5, the toner container 32, and the developer supply device 90 are divides into a unit including a group of two of the developing device 5, the toner container 32, and the developer supply device 90 and a rest of the developing device 5, the toner container 32, and the developer supply device 90, not into the unit of the developing device 5, the toner container 32, and the developer supply device 90 as described above. Specifically, the developing device 5 and the developer supply device 90 are a single divided unit, and the toner container is the other divided unit. Therefore, in the variation, the coupling portions 32Y1, 32M1, 32C1, 32K1, 32S1, 90Y1, 90M1, 90C1, 90K1, and 90S1 are disposed only between the five toner containers 32Y, 32M, 32C, 32K, and 32S and the five developer supply devices 90Y, 90M, 90C, 90K, and 90S. This configuration can attain effects similar to effects attained by the second embodiment described above.

With such a divided unit, when the RFID (the storage device) to store color data is installed as described in the first embodiment, the RFID of one of the developer supply device 90 and the developing device 5 can be omitted.

As described above, in the case of rearrangement of the plurality of developing devices 5Y, 5M 5C, 5K, and 5S; the plurality of toner containers 32Y, 32M, 32C, 32K, and 32S; and the plurality of developer supply devices 90Y, 90M, 90C, 90K, and 90S in the movement direction of the intermediate transfer belt 8, the image forming apparatus 100 according to the second embodiment, similarly to the first embodiment, can be used only when the colors of the developing device 5, the toner container 32, and the developer supply device 90 rearranged in a manner that the group of two of a developing device, a developer container, and a developer supply device corresponding to each color of the different colors is detached from and attached to the image forming apparatus, separately from a rest of the developing device, the developer container, and the developer supply device correspond to each other.

Therefore, when the arrangement of the plurality of toner containers 32Y, 32M, 32C, 32K, and 32S and the plurality of developer supply devices 90Y, 90M, 90C, 90K, and 90S are changed together with rearrangement of the plurality of developing devices 5Y, 5M 5C, 5K, and 5S, the problem that toners of different colors mix in the developing device 5 due to the misarrangement does not occur.

In the embodiments described above, the photoconductor drum 1Y serving as the image bearer, the charger 4Y, the developing device 5Y, and the cleaner 2Y are united as the process cartridge 6Y. However, the present disclosure is not limited to the embodiments described above and applied to the image forming apparatus 100 in which the developing device 5Y and the photoconductor drum 1Y are removably installed as a single unit, respectively.

It is to be noted that the term "process cartridge" used in the present specification means a unit including an image bearer and at least one of a charging device to charge the image bearer, a developing device to develop latent images on the image bearer, and a cleaner to clean the image bearer united together and is designed to be removably installed together in the apparatus body of the image forming apparatus.

In the above-described embodiments, the present disclosure is adopted to the image forming apparatus 100 in which the developer supply devices 90Y, 90M, 90C, 90K, and 90S include the cap holder 91, the reservoir 81, the conveyance pump 60, the sub-hopper 70, the tube 95, the conveyance pipe 98, but the configuration of the developer supply device 90 is not limited thereto.

In the above-described embodiments, the present disclosure is adopted to the image forming apparatus 100 in which the toner containers 32Y, 32M, 32C, 32K, and 32S are substantially cylindrical, and the bodies of the toner containers 32Y, 32M, 32C, 32K, and 32S are rotatably driven, but the configuration of the toner container is not limited thereto.

In the above-described embodiments, the present disclosure is adopted to the image forming apparatus 100 in which the plurality of photoconductor drums 1Y, 1M, 1C, 1K, and 1S (the image bearers) are arranged side by side along the movement direction of the intermediate transfer belt 8 (the intermediate transferor) that moves in the predetermined movement direction. On the other hand, the present disclosure can also be applied to an image forming apparatus employing a transfer conveyance belt, in which the plurality of image bearers is arranged side by side along the direction of movement of the sheet that moves with the transfer conveyance belt in the predetermined movement direction.

In such configurations, effects similar to those described above are attained.

Note that, it is clear that the present disclosure is not limited to the above-described embodiments, and modifications and variations of the above-described teachings are possible within the technical principles of the present disclosure. The number, position, shape of the components of the image forming apparatus are not limited to the embodiments described above and may be preferably set.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), DSP (digital signal processor), FPGA (field programmable gate array) and conventional circuit components arranged to perform the recited functions.

What is claimed is:

1. An image forming apparatus, comprising:

an intermediate transferor;

a plurality of image bearers arranged side by side along a movement direction of the intermediate transferor so as to face the intermediate transferor, and configured to bear latent images;

a plurality of developing devices configured to develop e latent images on the plurality of image bearers with different colors, respectively;

a plurality of developer containers configured to contain developers of the different colors; and a plurality of developer supply devices corresponding to the plurality of developing devices and the plurality of developer containers, respectively, and configured to supply the developers contained in the plurality of developer containers to the plurality of developing devices, respectively, wherein the plurality of developing devices, the plurality of developer containers, and the plurality of developer supply devices are configured to be rearrangeable for each color in the movement direction in such a manner that one or each of a developing device, a developer container, and a developer supply device corresponding to each color of the different colors is detachable from and attachable to the image forming apparatus, separately from a rest of the developing device, the developer container, and the developer supply device, and wherein the image forming apparatus is configured to be available for use when colors of the developing device, the developer container, and the developer supply device correspond to each other after rearrangement of the plurality of developing devices, plurality of developer containers, and the plurality of developer supply devices.

2. The image forming apparatus according to claim 1, further comprising:

a plurality of storage devices included in the plurality of developing devices, the plurality of developer containers, and the plurality of developer supply devices, respectively, to store color data of the developing device, the developer container, and the developer supply device corresponding to each color;

a reader configured to directly or indirectly read the color data stored in the plurality of storage devices; and circuitry configured to control image formation of the image forming apparatus, wherein the circuitry is configured to allow the image formation when the circuitry determines, based on the color data read by the reader, that the colors of the developing device, the developer container, and the developer supply device correspond to each other after the rearrangement of the plurality of developing devices, the plurality of developer containers, and the plurality of developer supply devices.

3. The image forming apparatus according to claim 2, further comprising an apparatus side storage device to store arrangement data of the plurality of developing devices, the plurality of developer containers, and the plurality of developer supply devices, wherein the circuitry is further configured to rewrite the arrangement data stored in the apparatus side storage device in response to a user's permission and allow the image formation when the circuitry determines that a color arrangement of the plurality of developing devices, the plurality of developer containers, and the plurality of developer supply devices after the rearrangement is different from the arrangement data.

4. The image forming apparatus according to claim 1, wherein the developing device, the developer container, and the developer supply device corresponding to each color include coupling portions to be coupled to each other, wherein the developing device, the developer container, and the developer supply device corresponding to each color are installable in the image forming apparatus to cause the image forming apparatus to be available for use, when the colors of the developing device, the developer container, and the developer supply device correspond to each other after the plurality of developing devices, the plurality of developer containers, and the plurality of developer supply devices are rearranged and the coupling portions are coupled to each other.

5. The image forming apparatus according to claim 4, wherein each of the coupling portions is detachable from and attachable to one of the developing device, the developer container, and the developer supply device corresponding to each color.

6. An image forming apparatus, comprising:

a plurality of image bearers arranged side by side along a movement direction of a sheet so as to face the sheet, and configured to bear latent images;

a plurality of developing devices configured to develop the latent images on the plurality of image bearers with different colors, respectively;

a plurality of developer containers configured to contain developers of the different colors; and a plurality of developer supply devices corresponding to the plurality of developing devices and the plurality of developer containers, respectively, and configured to supply the developers contained in the plurality of developer containers to the plurality of developing devices, respectively, wherein the plurality of developing devices, the plurality of developer containers, and the plurality of developer supply devices are configured to be rearrangeable for each color in the movement direction in such a manner that one or each of a developing device, a developer container, and a developer supply device corresponding to each color of the different colors is detachable from and attachable to the image forming apparatus, separately from a rest of the developing device, the developer container, and the developer supply device, and wherein the image forming apparatus is configured to be available for use when colors of the developing device, the developer container, and the developer supply device correspond to each other after rearrangement of the plurality of developing devices, plurality of developer containers, and the plurality of developer supply devices.

7. The image forming apparatus according to claim 6, further comprising:

a plurality of storage devices included in the plurality of developing devices, the plurality of developer containers, and the plurality of developer supply devices, respectively, to store color data of the developing device, the developer container, and the developer supply device corresponding to each color:

a reader configured to directly or indirectly read le color data stored in the plurality of storage devices: and circuitry configured to control image formation of the image forming apparatus, wherein the circuitry is configured to allow the image formation when the circuitry determines, based on the color data read by the reader, that the colors of the developing device, the developer container, and the developer supply device correspond to each other after the rearrangement of the plurality of developing devices, the plurality of developer containers, and the plurality of developer supply devices.

8. The image forming apparatus according to claim 7, further comprising an apparatus side storage device to store arrangement data of the plurality of developing devices, the plurality of developer containers, and the plurality of developer supply devices, wherein the circuitry is further configured to rewrite the arrangement data stored in the apparatus side storage device in response to a user's permission and allow the image formation when the circuitry deters cines that a color arrangement of the plurality of developing devices, the plurality of developer containers, and the plurality of developer supply devices after the rearrangement is different from the arrangement data.

9. The image forming apparatus according to claim 6, wherein the developing device, the developer container, and the developer supply device corresponding to each color include coupling portions to be coupled to each other, wherein the developing device, the developer container, and the developer supply device corresponding to each color are installable in the image forming apparatus to cause the image forming apparatus to be available for use, when the colors of the developing device, the developer container, and the developer supply device correspond to each other after the plurality of developing devices, the plurality of developer containers, and the plurality of developer supply devices are rearranged and the coupling portions are coupled to each other.

10. The image forming apparatus according to claim 9, wherein each of the coupling portions is detachable from and attachable to one of the developing device, the developer container, and the developer supply device corresponding to each color.

11. An image forming apparatus, comprising:

a first developing device to contain first color toner;

a first toner container to contain the first color toner;

a second developing device to contain second color toner; and a second toner container to contain the second color toner, wherein the first developing device and the second developing device are replaceable with each other, the first toner container and the second toner container are replaceable with each other, and the image forming apparatus is configured to he available for image formation only when an installation position in which the first developing device is installed corresponds to an installation position in which the first toner container is installed, and an installation position in which the second developing device is installed corresponds to an installation position in which the second toner container is installed after at least one of replacement of the first developing device and the second developing device and replacement of the first toner container and the second toner container.

12. The image forming apparatus of claim 11, further comprising circuitry configured to control the image formation of the image forming apparatus, wherein the circuitry is configured to allow the image formation when the circuitry determines that the installation position in which the first developing device is installed corresponds to the installation position in which the first toner container is installed, and the installation position in which the second developing device is installed corresponds to the installation position in which the second toner container is installed.

* * * * *